US010492014B2

(12) United States Patent
Breebaart et al.

(10) Patent No.: US 10,492,014 B2
(45) Date of Patent: Nov. 26, 2019

(54) SPATIAL ERROR METRICS OF AUDIO CONTENT

(71) Applicants: DOLBY LABORATORIES LICENSING CORPORATION, San Francisco, CA (US); DOLBY INTERNATIONAL AB, Amsterdam Zuidoost (NL)

(72) Inventors: Dirk Jeroen Breebaart, Pyrmont (AU); Lianwu Chen, Beijing (CN); Lie Lu, Beijing (CN); Antonio Mateos Sole, Barcelona (ES); Nicolas R. Tsingos, Palo Alto, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 41 days.

(21) Appl. No.: 15/110,371

(22) PCT Filed: Jan. 5, 2015

(86) PCT No.: PCT/US2015/010126
§ 371 (c)(1),
(2) Date: Jul. 18, 2016

(87) PCT Pub. No.: WO2015/105748
PCT Pub. Date: Jul. 16, 2015

(65) Prior Publication Data

US 2016/0337776 A1 Nov. 17, 2016

Related U.S. Application Data

(60) Provisional application No. 61/951,048, filed on Mar. 11, 2014.

(30) Foreign Application Priority Data

Jan. 9, 2014 (ES) ..... 201430016

(51) Int. Cl.
*H04S 7/00* (2006.01)
*F24C 15/20* (2006.01)
(Continued)

(52) U.S. Cl.
CPC ..... *H04S 7/30* (2013.01); *F24C 15/2028* (2013.01); *G10L 19/008* (2013.01); *G10L 25/48* (2013.01);
(Continued)

(58) Field of Classification Search
CPC ..... G10L 19/008; H04S 2400/11
See application file for complete search history.

(56) References Cited

U.S. PATENT DOCUMENTS 7,356,465 B2 * 4/2008 Tsingos ..... H04S 7/30 704/203
7,617,099 B2 * 11/2009 Yang ..... H04R 3/005 704/228
(Continued)

FOREIGN PATENT DOCUMENTS

CN 101485202 7/2009
CN 101547000 9/2009
(Continued)

OTHER PUBLICATIONS

Vetro A., "Object-Based Encoding and Transcoding," Dissertation, Polytechnic University, Jun. 2001, 177 pages.
(Continued)

*Primary Examiner* — Kile O Blair

(57) ABSTRACT

Audio objects that are present in input audio content in one or more frames are determined. Output clusters that are
(Continued)

present in output audio content in the one or more frames are also determined. Here, the audio objects in the input audio content are converted to the output clusters in the output audio content. One or more spatial error metrics are computed based at least in part on positional metadata of the audio objects and positional metadata of the output clusters.

21 Claims, 7 Drawing Sheets

(51) Int. Cl.

| | |
|---|---|
| ***G10L 19/008*** | (2013.01) |
| ***H04S 3/00*** | (2006.01) |
| ***G10L 25/48*** | (2013.01) |
| ***H04R 29/00*** | (2006.01) |

(52) U.S. Cl.
CPC ..... *H04R 29/008* (2013.01); *H04S 3/008* (2013.01); *H04S 2400/13* (2013.01)

(56) References Cited

U.S. PATENT DOCUMENTS

| | | | | |
|---|---|---|---|---|
| 7,945,119 | B2 | 5/2011 | Matskewich | |
| 8,155,971 | B2 | 4/2012 | Hellmuth | |
| 8,271,289 | B2 | 9/2012 | Kim | |
| 8,295,494 | B2 | 10/2012 | Oh | |
| 8,363,865 | B1 | 1/2013 | Bottum | |
| 2004/0162721 | A1* | 8/2004 | Oomen | G10L 19/0212 704/203 |
| 2005/0114121 | A1 | 5/2005 | Tsingos | |
| 2008/0084934 | A1 | 4/2008 | Agrawal | |
| 2010/0061446 | A1 | 3/2010 | Hands | |
| 2011/0022402 | A1 | 1/2011 | Engdegard | |
| 2012/0143613 | A1 | 6/2012 | Herre | |
| 2014/0023197 | A1* | 1/2014 | Xiang | H04S 1/007 381/17 |
| 2015/0332680 | A1 | 11/2015 | Crockett | |

FOREIGN PATENT DOCUMENTS

| | | |
|---|---|---|
| CN | 101582262 | 11/2009 |
| CN | 101859563 | 10/2010 |
| GB | 2459012 | 10/2009 |
| JP | 2010-511190 | 4/2010 |
| JP | 2011-209588 | 10/2011 |
| JP | 2012-525600 | 10/2012 |
| KR | 10-2004-0009925 | 1/2004 |
| WO | 2008/100098 | 8/2008 |
| WO | 2013/006325 | 1/2013 |
| WO | 2014/025752 | 2/2014 |

OTHER PUBLICATIONS

Moore B.C.J. et al "A Model for the Prediction of Thresholds, Loudness, and Partial Loudness," J. Audio Eng. Soc., 45(4)224-240, Apr. 1997.

* cited by examiner

SPATIAL ERROR METRICS OF AUDIO CONTENT

CROSS REFERENCE TO RELATED APPLICATIONS

This application claims priority to Spanish Patent Application No. P201430016, filed 9 Jan. 2014 and U.S. Provisional Patent Application No. 61/951,048, filed on 11 Mar. 2014, each of which is hereby incorporated by reference in its entirety.

TECHNOLOGY

The present invention relates generally to audio signal processing, and more specifically to determining spatial error metrics and audio quality degradation associated with format conversion, rendering, clustering, remixing or combining of audio objects.

BACKGROUND

Input audio content such as originally authored/produced audio content, etc., may comprise a large number of audio objects individually represented in an audio object format. The large number of audio objects in the input audio content can be used to create a spatially diverse, immersive and accurate audio experience.

However, the encoding, decoding, transmission, playback, etc., of the input audio content comprising the large number of audio objects may require high bandwidth, large memory buffers, high processing power, etc. Under some approaches, the input audio content may be transformed into output audio content comprising a smaller number of audio objects. The same input audio content may be used to generate many different versions of output audio content corresponding to many different audio content distribution, transmission and playback settings, such as those related to Blu-ray disc, broadcast (e.g., cable, satellite, terrestrial, etc.), mobile (e.g., 3G, 4G, etc.), internet, etc. Each version of output audio content may be specifically adapted for a corresponding setting to address specific challenges for efficient representation, processing, transmission and rendering of commonly derived audio content in the setting.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1:
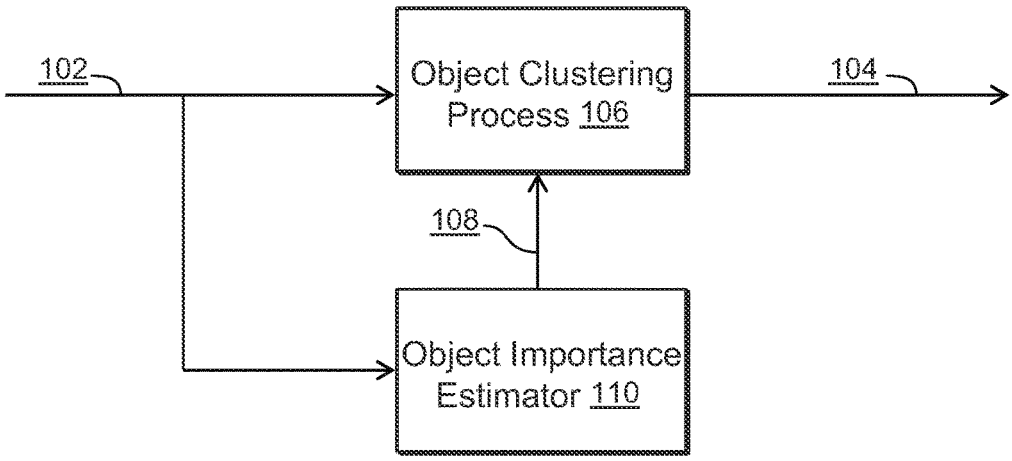
FIG. 1 illustrates example computer-implemented modules involved in audio object clustering.

Example embodiments, which relate to determining spatial error metrics and audio quality degradation relating to audio object clustering, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Example embodiments are described herein according to the following outline:

1. GENERAL OVERVIEW
2. AUDIO OBJECT CLUSTERING
3. SPATIAL COMPLEXITY ANALYZER
4. SPATIAL ERROR METRICS
   - 4.1 INTRA-FRAME OBJECT POSITION ERRORS
   - 4.2 INTRA-FRAME OBJECT PANNING ERRORS
   - 4.3 IMPORTANCE-WEIGHTED ERROR METRICS
   - 4.4 NORMALIZED ERROR METRICS
   - 4.5 INTER-FRAME SPATIAL ERRORS
5. PREDICTION OF SUBJECTIVE AUDIO QUALITY
6. VISUALIZATION OF SPATIAL ERRORS AND SPATIAL COMPLEXITY
7. EXAMPLE PROCESS FLOW
8. IMPLEMENTATION MECHANISMS—HARDWARE OVERVIEW
9. EQUIVALENTS, EXTENSIONS, ALTERNATIVES AND MISCELLANEOUS

1. General Overview

This overview presents a basic description of some aspects of an embodiment of the present invention. It should be noted that this overview is not an extensive or exhaustive summary of aspects of the embodiment. Moreover, it should be noted that this overview is not intended to be understood as identifying any particularly significant aspects or elements of the embodiment, nor as delineating any scope of the embodiment in particular, nor the invention in general. This overview merely presents some concepts that relate to the example embodiment in a condensed and simplified format, and should be understood as merely a conceptual prelude to a more detailed description of example embodiments that follows below.

A wide variety of audio object-based audio formats may exist that can be transformed, down-mixed, converted, transcoded, etc., from one format to another. In an example, one format may employ a Cartesian coordinate system to describe the position of audio objects or output clusters, while other formats may employ an angular approach, possibly augmented with distance. In another example, in order to efficiently store and transmit object-based audio content, audio object clustering may be performed on a set of input audio objects to reduce a relatively large number of the input audio objects into a relatively small number of output audio objects or output clusters.

Techniques as described herein can be used to determine spatial error metrics and/or audio quality degradation associated with format conversion, rendering, clustering, remixing or combining, etc., of one set of (e.g., dynamic, static, etc.) audio objects constituting input audio content to another set of audio objects constituting output audio content. For the purpose of illustration only, the audio objects or input audio objects in the input audio content may sometimes be referred to simply as "audio objects." The audio objects or the output audio objects in the output audio content may generally be referred to as "output clusters." It should be noted that in various embodiments, the terms "audio objects" and "output clusters" are used in relation to a specific conversion operation that converts the audio objects to the output clusters. For example, output clusters in one conversion operation may well be input audio objects in a subsequent conversion operation; similarly, input audio objects in the current conversion operation may well be output clusters in a previous conversion operation.

If the input audio objects are relatively few or sparse, one-to-one mappings from the input audio objects to the output clusters are possible for at least some of the input audio objects.

In some embodiments, an audio object may represent one or more sound elements (e.g., an audio bed, or a portion of audio bed, a physical channel, etc.) at a fixed location. In some embodiments, an output cluster may also represent one or more sound elements (e.g., an audio bed, or a portion of audio bed, a physical channel, etc.) at a fixed location. In some embodiments, an input audio object that has dynamic positions (or non-fixed positions) may be clustered into an output cluster that has a fixed location. In some embodiments, an input audio object (e.g., an audio bed, a portion of an audio bed, etc.) that has a fixed position may be mapped to an output cluster (e.g., an audio bed, a portion of an audio bed, etc.) that has a fixed location. In some embodiments, all output clusters have fixed positions. In some embodiments, at least one of the output clusters has dynamic positions.

As input audio objects in input audio content are converted into output clusters in output audio content, the number of output clusters may or may not be smaller than the number of audio objects. An audio object in the input audio content may be apportioned into more than one output cluster in the output audio content. An audio object also may be assigned solely to an output cluster that may or may not be located at the same position as the audio object is located at. Shifting of positions of the audio objects into positions of the output clusters induces spatial errors. The techniques as described herein can be used to determine spatial error metrics and/or audio quality degradation relating to the spatial errors due to the conversion from the audio objects in the input audio content to the output clusters in the output audio content.

The spatial error metrics and/or the audio quality degradation determined under the techniques as described herein may be used in addition to, or in place of, other quality metrics (e.g., PEAQ, etc.) that measure coding errors caused by lossy codecs, quantization errors, etc. In an example, the spatial error metrics, the audio quality degradation, etc., can be used together with positional metadata and other metadata in the audio objects or output clusters to visually convey spatial complexity of audio content in multi-channel multi-object based audio content.

Additionally, optionally, or alternatively, in some embodiments, audio quality degradation may be provided in the form of predicted test scores that are generated based on one or more spatial error metrics. A predicted test score may be used as an indication of perceptual audio quality degradation, relative to input audio content, of output audio content or a portion thereof (e.g., in a frame, etc.) without actually conducting any user survey of perceptual audio qualities of the input audio content and the output audio content. The predicted test score may pertain to a subjective audio quality test such as a MUSHRA (MUltiple Stimuli with Hidden Reference and Anchor) test, a MOS (Mean Opinion Score) test, etc. In some embodiments, one or more spatial error metrics are converted to one or more predicted test scores using prediction parameters (e.g., correlation factors, etc.) determined/optimized from one or more representative sets of training audio content data.

For example, each element (or excerpt) in the sets of training audio content data may be subject to subjective user surveys of perceptual audio qualities before and after input audio objects in the element (or excerpt) are converted or mapped into corresponding output clusters. Test scores as determined from the user surveys may be correlated with spatial error metrics computed based on the input audio objects in the element (or excerpt) and corresponding output clusters for the purpose of determining or optimizing the prediction parameters, which can then be used to predict test scores for audio content that are not necessarily in the set of training data.

A system under techniques as described herein may be configured to provide the spatial error metrics and/or the audio quality degradation in an objective manner to audio engineers that are directing a process, operation, algorithm, etc., of converting (audio objects in) input audio content to (output clusters in) output audio content. The system may be configured to accept user input or receive feedback from the audio engineers to optimize the process, operation, algorithm, etc., for the purpose of alleviating or preventing the audio quality degradation, to minimize spatial errors significantly impacting the audio quality of the output audio content, etc.

In some embodiments, object importance is estimated or determined for individual audio objects or output clusters and used for estimating the spatial complexity and spatial errors. For example, an audio object that is silent or masked by other audio objects in terms of relative loudness and positional proximity may be subject to larger spatial errors by assigning such an audio object less object importance. As the less important audio object is relatively quiet as opposed to other audio objects that are more dominant in a scene, the larger spatial errors of the less important audio object may create little audible artifacts.

Techniques as described herein can be used to compute intra-frame spatial error metrics as well as inter-frame spatial error metrics. Examples of intra-frame spatial error metrics include, but are not limited to, any of: object position error metrics, object panning errors, spatial error metrics weighted by object importance, normalized spatial error metrics weighted by object importance, etc. In some embodiments, an intra-frame spatial error metric can be computed as an objective quality metric based on: (i) audio sample data in audio objects including, but not limited to, individual object importance of the audio objects in their respective contexts; and (ii) differences between original positions of the audio objects before the conversion and reconstructed positions of the audio objects after the conversion.

Examples of inter-frame spatial error metrics include, but are not limited to, those related to products of gain coefficient differences and positional differences of output clusters in (time-wise) adjacent frames, those related to gain coefficient flows in (time-wise) adjacent frames, etc. The inter-frame spatial error metrics may be particularly useful for indicating inconsistency in (time-wise) adjacent frames; for example, a change in audio objects-to-output-clusters allocations/apportions across time-wise adjacent frames may result in audible artifacts, due to inter-frame spatial errors created during the interpolation from one frame to the next.

In some embodiments, the inter-frame spatial error metrics can be computed based on: (i) gain coefficient differences relating to the output clusters over time (e.g., between two adjacent frames, etc.); (ii) positional changes of the output clusters over time (e.g., when an audio object is panned into a cluster, a corresponding panning vector of an audio object to the output clusters changes; (iii) relative loudness of the audio object; etc. In some embodiments, the inter-frame spatial error metrics can be computed based at least in part on gain coefficient flows among the output clusters.

Spatial error metrics and/or audio quality degradation as described herein may be used to drive one or more user interfaces to interact with a user. In some embodiments, a visual complexity meter is provided in the user interfaces to show spatial complexity (e.g., high quality/low spatial complexity, low quality/high spatial complexity, etc.) of a set of audio objects relative to a set of output clusters to which the audio objects are converted. In some embodiments, the visual spatial complexity meter displays an indication of audio quality degradation (e.g., predicted test scores relating to a perceptual MOS test, a MUSHRA test, etc.) as a feedback to a corresponding conversion process that converts the input audio objects to the output clusters. Values of spatial error metrics and/or audio quality degradation may be visualized in the user interfaces on a display using VU meters, bar charts, clip lights, numerical indicators, other visual components, etc., to visually convey spatial complexity and/or spatial error metrics associated with the conversion process.

In some embodiments, mechanisms as described herein form a part of a media processing system, including, but not limited to, any of: a handheld device, game machine, television, home theater system, set-top box, tablet, mobile device, laptop computer, netbook computer, cellular radiotelephone, electronic book reader, point of sale terminal, desktop computer, computer workstation, computer kiosk, various other kinds of terminals and media processing units, etc.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

Any of embodiments as described herein may be used alone or together with one another in any combination. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

2. Audio Object Clustering

Audio objects can be considered individual or collections of sound elements that may be perceived to emanate from a particular physical location or locations in the listening space (or environment). Examples of audio objects include, but are not limited only to, any of: tracks in an audio production session, etc. An audio object can be static (e.g., stationary) or dynamic (e.g., moving). The audio object comprises metadata separate from audio sample data that represents one or more sound elements. The metadata comprises positional metadata that defines one or more positions (e.g., a dynamic or fixed centroid position, a fixed position of a speaker in a listening space, a set of one, two or more dynamic or fixed positions representing ambient effects, etc.) of one or more of the sound elements at a given point in time (e.g., in one or more frames, in one or more portions of frames, etc.). In some embodiments, when an audio object is played back, it is rendered according to its positional metadata using speakers that are present in the actual playback environment, rather than necessarily being output to a predefined physical channel of a reference audio channel configuration assumed by an upstream audio encoder that encodes the audio object into an audio signal for the benefits of downstream audio decoders.

FIG. 1 illustrates example computer-implemented modules for audio object clustering. As shown in FIG. 1, input audio objects 102 collectively representing input audio content are converted into output clusters 104 through an audio object clustering process 106. In some embodiments, the output clusters 104 collectively represent output audio content and constitute a more compact representation (e.g., a smaller number of audio objects, etc.) of the input audio content than the input audio objects, thus allowing for reduced storage and transmission requirements; and reduced computational and memory requirements for reproduction of the input audio content, especially on consumer-domain devices with limited processing capabilities, limited battery power, limited communication capacities, limited reproduction capabilities, etc. However, audio object clustering results in a certain amount of spatial error since not all input audio objects can maintain spatial fidelity when clustered with other audio objects, especially in embodiments in which there exist a large number of sparsely distributed input audio objects.

In some embodiments, the audio object clustering process 106 clusters the input audio objects 102 based at least in part on object importance 108 that are generated from one or more of sample data, audio object metadata, etc., of the input audio objects. The sample data, audio object metadata, etc., are input to an object importance estimator 110, which generates the object importance 108 for use by the audio object clustering process 106.

As described herein, the object importance estimator 110 and the audio object clustering process 106 can be performed as functions of time. In some embodiments, an audio signal encoded with the input audio objects 102, or a corresponding audio signal encoded with the output clusters 104 generated from the input audio objects 102, can be segmented into individual frames (e.g., a unit of time duration such as 20 milliseconds, etc.). Such segmentation may be applied on time-domain waveforms, but also using filter banks, or any other transform domain. The object importance estimator (110) can be configured to generate respective object importance of the input audio objects (102) on one or more characteristics of the input audio objects (102) including but not limited to content type, partial loudness, etc.

Partial loudness as described herein may represent (relative) loudness of an audio object in the context of a set, collection, group, plurality, cluster, etc., of audio objects according to psychoacoustic principles. Partial loudness of an audio object can be used to determine object importance of the audio object, to selectively render audio objects if an audio rendering system does not have sufficient capabilities to render all audio objects individually, etc.

An audio object may be classified into one of a number of (e.g., defined, etc.) content types, such as dialog, music, ambience, special effects, etc., at a given time (e.g., on a per-frame basis, in one or more frames, in one or more portions of a frame, etc.). An audio object may change content type throughout its time duration. An audio object (e.g., in one or more frames, in one or more portions of a frame, etc.) can be assigned a probability that the audio object is a particular content type in the frame. In an example, an audio object of a constant dialog type may be expressed as a one-hundred percent probability. In another example, an audio object that transforms from a dialog type to a music type may be expressed as fifty percent dialog/fifty percent music, or a different percentile combination of dialog and music types.

The audio object clustering process 106, or a module operating with the audio object clustering process 106, may be configured to determine content types (e.g., expressed as a vector with components having Boolean values, etc.) of an audio object and probabilities (e.g., expressed as a vector of components having percentile values, etc.) of the content types of the audio object on the per-frame basis. Based on the content types of the audio object, the audio object clustering process 106 may be configured to cluster the audio object into a particular output cluster, to assign a mutual one-to-one mapping between the audio object and an output cluster, etc., on a per-frame basis, in one or more frames, in one or more portions of a frame, etc.

For the purpose of illustration, an i-th audio object, among a plurality of audio objects (e.g., input audio objects 102, etc.) that exist in an m-th frame, may be represented by a corresponding function $x_i(n,m)$, where n is an index denoting the n-th audio data sample among a plurality of audio data samples in the m-th frame. The total number of audio data samples in a frame such as the m-th frame, etc., depends on the sampling rate (e.g., 48 kHz, etc.) at which an audio signal is sampled to create the audio data samples.

In some embodiments, the plurality of audio objects the m-th frame are clustered into a plurality of output clusters $y_j(n,m)$ based on a linear operation (e.g., in an audio object clustering process, etc.), as shown in the following expression:

$$y_j(n,m)=\Sigma_i g_{ij} x_i(n,m), \tag{1}$$

where $g_{ij}(m)$ denotes a gain coefficient of object i to cluster j. To avoid discontinuities in the output clusters $y_j(n,m)$, clustering operations can be performed over windowed, partially-overlapping frames to interpolate changes of $g_{ij}(m)$ across the frames. As used herein, a gain coefficient represents an apportionment of a portion of a specific input audio object to a specific output cluster. In some embodiments, the audio object clustering process (106) is configured to generate a plurality of gain coefficients for mapping input audio objects into output clusters according to expression (1). Alternatively, additionally, or optionally, gain coefficients $g_{ij}(m)$ may be interpolated across samples (n) to create interpolated gain coefficients $g_{ij}(m,n)$. Alternatively, the gains coefficients can be frequency-dependent. In such embodiments, the input audio is either split into frequency bands using a suitable filter bank, and possibly different sets of gain coefficients are applied to each spitted audio.

3. Spatial Complexity Analyzer

Figure 2:
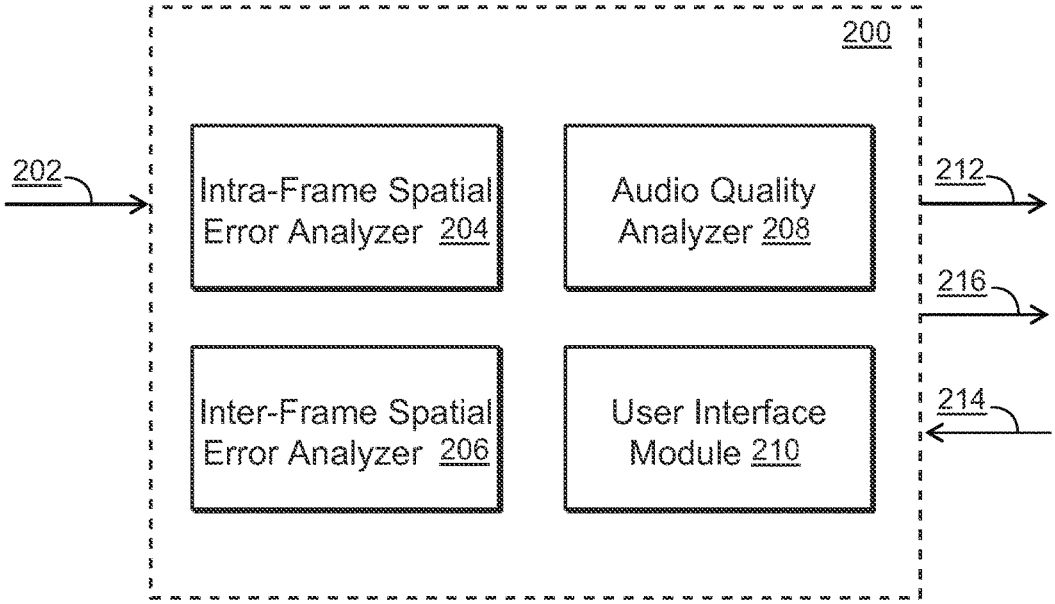
FIG. 2 illustrates an example spatial complexity analyzer.

FIG. 2 illustrates an example spatial complexity analyzer 200 comprising a number of computer-implemented modules such as an intra-frame spatial error analyzer 204, an inter-frame spatial error analyzer 206, an audio quality analyzer 208, a user interface module 210, etc. As shown in FIG. 2, the spatial complexity analyzer 200 is configured to receive/collect audio object data 202 that is to be analyzed for spatial errors and audio quality degradation with respect to a set of input audio objects (e.g., 102 of FIG. 1, etc.) and a set of output clusters (e.g., 104 of FIG. 1, etc.) to which the input audio objects are converted. The audio object data 202 comprises one or more of metadata for the input audio objects (102), metadata for the output clusters (104), gain coefficients that map the input audio objects (102) to the output clusters (104) as shown in expression (1), partial loudness of the input audio objects (102), object importance of the input audio objects (102), content types of the input audio objects (102), probabilities of content types of the input audio objects (102), etc.

In some embodiments, the intra-frame spatial error analyzer (204) is configured to determine one or more types of intra-frame spatial error metrics based on the audio object data (202) on a per-frame basis. In some embodiments, for each frame, the intra-frame spatial error analyzer (204) is configured to: (i) extract the gain coefficients, positional metadata of the input audio objects (102), positional metadata of the output clusters (102), etc., from the audio object data (202); (ii) compute, individually for each input audio object in the frame, each of the one or more types of intra-frame spatial error metrics based on the extracted data from the audio object data (202) in the input audio object in the frame; etc.

The intra-frame spatial error analyzer (204) can be configured to compute an overall per-frame spatial error metric for a corresponding type in the one or more types of intra-frame spatial error metrics, etc., based on spatial errors individually computed for the input audio objects (102). The overall per-frame spatial error metric may be computed by weighting spatial errors of individual audio objects with a weight factor such as respective object importance of the input audio objects (102) in the frame, etc. Additionally, optionally or alternatively, the overall per-frame spatial error metric may be normalized with a normalization factor relating to a sum of weight factors such as a sum of values indicating respective object importance of the input audio objects (102) in the frame, etc.

In some embodiments, the inter-frame spatial error analyzer (206) is configured to determine one or more types of inter-frame spatial error metrics based on the audio object data (202) for two or more adjacent frames. In some embodiments, for two adjacent frames, the inter-frame spatial error analyzer (206) is configured to (i) extract the gain coefficients, positional metadata of the input audio objects (102), positional metadata of the output clusters (102), etc., from the audio object data (202); (ii) compute, individually for each input audio object in the frames, each of the one or more types of inter-frame spatial error metrics based on the extracted data from the audio object data (202) in the input audio object in the frames; etc.

The inter-frame spatial error analyzer (206) can be configured to compute, for two or more adjacent frames, an overall spatial error metric for a corresponding type in the one or more types of inter-frame spatial error metrics, etc., based on spatial errors individually computed for the input audio objects (102) in the frames. The overall spatial error metric may be computed by weighting spatial errors of individual audio objects with weight factors such as respective object importance of the input audio objects (102) in the frames, etc. Additionally, optionally or alternatively, the overall spatial error metric may be normalized with a normalization factor, for example one related to the respective object importance of the input audio objects (102) in the frames.

In some embodiments, the audio quality analyzer (208) is configured to determine perceptual audio quality based on one or more of intra-frame spatial error metrics or inter-frame spatial error metrics, for example, generated by the intra-frame spatial error analyzer (204) or the inter-frame spatial error analyzer (206). In some embodiments, the perceptual audio quality is indicated by one or more predicted test scores that are generated based on the one or more of the spatial error metrics. In some embodiments, at least one of the predicted test scores pertains to a subjective evaluation test of audio quality such as a MUSHRA test, a MOS test, etc. The audio quality analyzer (208) may be configured with prediction parameters (e.g., correlation factors, etc.) predetermined from one or more sets of training data, etc. In some embodiments, the audio quality analyzer (208) is configured to convert the one or more of the spatial error metrics to one or more predicted test scores based on the prediction parameters.

In some embodiments, the spatial complexity analyzer (200) is configured to provide one or more of spatial error metrics, audio quality degradation, spatial complexity, etc., as determined under techniques as described herein as output data 212 to users or other devices. Additionally, optionally, or alternatively, in some embodiments, the spatial complexity analyzer (200) can be configured to receive user input 214 that provides feedbacks or changes to processes, algorithms, operational parameters, etc., that are used in converting the input audio content to the output audio content. An example of such feedback is object importance. Additionally, optionally, or alternatively, in some embodiments, the spatial complexity analyzer (200) can be configured to send control data 216 to the processes, algorithms, operational parameters, etc., that are used in converting the input audio content to the output audio content, for example, based on the feedback or changes as received in the user input 214, or based on the estimated spatial audio quality.

In some embodiments, the user interface module (210) is configured to interact with a user through one or more user interfaces. The user interface module (210) can be configured to present, or cause displaying, user interface components depicting some or all of the output data 212 to the user through the user interfaces. The user interface module (210) can be further configured to receive some, or all, of the user input 214 through the one or more user interfaces.

4. Spatial Error Metrics

A plurality of spatial error metrics may be computed based on overall spatial errors in a single frame, or in multiple adjacent frames. In determining/estimating overall spatial error metrics and/or overall audio quality degradation, object importance can play a major role. An audio object that is silent, relatively quiet, or (partially) masked by other audio objects (e.g., in terms of loudness, spatial adjacency, etc.) may be subject to larger spatial errors before artifacts of audio object clustering become audible than audio objects that are dominant in the current scene. For the purpose of illustration, in some embodiments, an audio object with an index i has respective object importance (denoted as $N_i$). This object importance may be generated by object importance estimator (110 of FIG. 1) based on a number of properties including but not limited only to, any of: the partial loudness of an audio object relative to those of audio beds and other audio objects according to a perceptual loudness model, semantic information such as the probability of being dialogue, etc. Given the dynamic nature of audio content, object importance $N_i(m)$ of the i-th audio object typically varies as a function of time, for example, as a function of a frame index m (which logically represents or maps to time such as media playback time, etc.). Additionally, the object importance metric may depend on the metadata of the object. An example of such dependency is the modification of object importance based on the position or the speed of movement of an object.

Object importance may be defined as a function of time as well as frequency. As described herein, transcoding, importance estimating, audio object clustering, etc., may be performed in frequency bands using any suitable transform, such as a Discrete Fourier Transform (DFT), a Quadrature Mirror Filter (QMF) bank, (Modified) Discrete Cosine Transform (MDCT), auditory filter bank, similar transformation process, etc. Without loss of generality, the m-th frame (or a frame with a frame index m) comprises a set of audio samples in the time domain or in a suitable transform domain.

4.1 Intra-Frame Object Position Errors

One of intra-frame spatial error metrics relates to object position errors and may be denoted as the intra-frame object position error metric.

Each audio object (e.g., the i-th audio object, etc.) in expression (1) has an associated position vector (e.g., $\vec{p}_i(m)$, etc.) for each frame (e.g., m, etc.). Similarly, each output cluster (e.g., the j-th output cluster, etc.) in expression (1) also has an associated position vector (e.g., $\vec{p}_j$ (m), etc.). These position vectors may be determined by a spatial complexity analyzer (e.g., 200, etc.) based on positional metadata in the audio object data (202). A position error of an audio object may be represented by a distance between a position of the audio object and a position of the center-of-mass of the audio object as apportioned to the output clusters. In some embodiments, the position of the center-of-mass of the i-th audio object is determined as a weighted-sum of positions of the output clusters to which the audio object is apportioned with gain coefficient $g_{ij}(m)$ serving as weight factors. The distance squared between the position of the audio object and the position of the center-of-mass of the audio object as apportioned to the output clusters may be computed with the following expression:

$$E_i^2(m) = \left| \vec{p}_i(m) - \frac{\Sigma_j g_{ij}(m)\vec{p}_j(m)}{\Sigma_j g_{ij}(m)} \right|^2 \tag{2}$$

The weighted-sum of positions of the output clusters on the right-hand-side (RHS) of expression (2) is representative of the perceived position of the i-th audio object. $E_i(m)$ may be referred to as the intra frame object position error of the i-th audio object in frame m.

In an example implementation, the gain coefficients (e.g., $g_{ij}(m)$, etc.) are determined by optimizing a cost function for each audio object (e.g., the i-th audio object, etc.). Examples of cost functions used to obtain the gain coefficients in expression (1) include but are not limited to, any of: $E_i(m)$, an L2 norm other than $E_i(m)$, etc. It should be noted that techniques as described herein can be configured to use gain coefficients obtained through optimizing with other types of cost functions other than $E_i(m)$.

In some embodiments, the intra-frame object position error as represented by $E_i(m)$ is only large for audio objects with positions outside the convex hull of the output clusters, and is zero inside the convex hull.

4.2 Intra-Frame Object Panning Errors

Even in cases in which an audio object's position error as represented in expression (2) is zero (e.g., within the convex hull of the output clusters, etc.), the audio object may still sound considerably different after clustering and rendering, as compared with rendering the audio object directly without clustering. This may occur if none of the cluster centroids has a location in the vicinity of the audio object's position, and hence the audio object (e.g., sample data portions, a signal representing the audio object, etc.) is distributed among various output clusters. An error metric relating to the intra frame object panning error of the i-th audio object in frame m may be represented by the following expression:

$$F_i^2(m)=\Sigma_j g_{ij}^2(m)|\vec{p}(m)-\vec{p}_j(m)|^2 \tag{3}$$

In some embodiments in which gain coefficients $g_{ij}(m)$ in expression (1) is computed by the center-of-mass optimization, the error metric $F_i^2(m)$ in expression (3) is zero if one (e.g., the j-th output cluster, etc.) of the output clusters has a position $\vec{p}_j$ that coincides with the object position $\vec{p}_i$. Without such coincidences, however, panning objects into the centroids of the output clusters results in a non-zero value of $F_i^2(m)$.

4.3 Importance-Weighted Error Metrics

In some embodiments, the spatial complexity analyzer (200) is configured to weight an individual object error metric (e.g., $E_i$, $F_i$, etc.) of each audio object in the scene with respective object importance (e.g., determined based on partial loudness $N_i$, etc.). The object importance, partial loudness $N_i$, etc., may be estimated or determined by the spatial complexity analyzer (200) from the received audio object data (202). The object error metric as weighted by the respective object importance can be summed up to generate an overall error metric for all audio objects in the scene as shown in the following expressions:

$$A_{E_i}(m)=\Sigma_i E_i(m)N_i(m)$$

$$A_{F_i}(m)=\Sigma_i F_i(m)N_i(m) \tag{4}$$

Alternatively, additionally or optionally, an individual error metric (e.g., $E_i$, $F_i$, etc.) of each audio object in the scene can be summed up to generate an overall error metric in the squared domain for all audio objects in the scene as shown in the following expressions:

$$A_{E_i^2}(m)=\sqrt{\Sigma_i E_i^2(m)N_i^2(m)}$$

$$A_{F_i^2}(m)=\sqrt{\Sigma_i F_i^2(m)N_i^2(m)} \tag{5}$$

4.4 Normalized Error Metrics

The unnormalized error metrics in expressions (4) and (5) can be normalized with the overall loudness or object importance, as shown in the following expressions:

$$A'_{E_i}(m)=\frac{\sum_i E_i(m)N_i(m)}{\sum_i N_i(m)+N_0} \tag{6}$$

$$A'_{F_i}(m)=\frac{\sum_i F_i(m)N_i(m)}{\sum_i N_i(m)+N_0}$$

-continued $$A'_{E_i^2}(m)=\sqrt{\frac{\sum_i E_i^2(m)N_i^2(m)}{\sum_i N_i^2(m)+N_0^2}} \tag{7}$$

$$A'_{F_i^2}(m)=\sqrt{\frac{\sum_i F_i^2(m)N_i^2(m)}{\sum_i N_i^2(m)+N_0^2}}$$

where $N_0$ is a numeric stability factor to prevent numeric instability that may occur if a sum of the partial loudness or the partial loudness squared approaches zero (e.g., when a portion of audio content is quiet or near quiet, etc.). The spatial complexity analyzer (200) may be configured with a specific threshold (e.g., a minimum quietness, etc.) for the sum of the partial loudness or the partial loudness squared. The stability factor may be inserted in expressions (7) if this sum is at or below the specific threshold. It should be noted that techniques as described herein can also be configured to work with other ways of preventing numeric instability such as damping, etc., in computing un-normalized or normalized error metrics.

In some embodiments, spatial error metrics are computed for each frame m and subsequently low-pass filtered (e.g., with a first-order low-pass filter with a time constant such as 500 ms, etc.); the maximum, the mean, the median, etc., of the spatial error metrics may be used as an indication of audio quality of the frame.

4.5 Inter-Frame Spatial Errors

In some embodiments, spatial error metrics related to changes in adjacent frames in time may be computed and may be referred to herein inter-frame spatial error metrics. These inter-frame spatial error metrics may, but are not limited to, be used in situations in which spatial errors (e.g., intra-frame spatial errors) in each of the adjacent frames may be very small or even zero. Even with small intra-frame spatial errors, a change in object-to-cluster allocations across frames may nevertheless result in audible artifacts, for example, due to the spatial errors created during the interpolation from one frame to the next.

In some embodiments, inter-frame spatial errors of an audio object as described herein are generated based on one or more spatial error related factors including, but not limited only to, any of: positional changes of output cluster centroids to which the audio object is clustered or panned, changes of gain coefficients relative to the output clusters to which the audio object is clustered or panned, positional changes of the audio object, relative or partial loudness of the audio object, etc.

An example inter-frame spatial error can be generated based on changes of gain coefficients of an audio object and positional changes of output clusters to which the audio object is clustered or panned, as shown in the following expression:

$$\Sigma_j|g_{ij}(m)-g_{ij}(m+1)||\vec{p}_j(m)-\vec{p}_j(m+1)| \tag{8}$$

The above metric provides a large error if (1) gain coefficients of the audio object change considerably, and/or (2) positions of the output clusters to which the audio object is clustered or panned change considerably. Furthermore, the above metric can be weighted by specific object importance of the audio object such as the partial loudness, etc., as shown in the following expression:

$$A_i^2(m\rightarrow m+1)=\Sigma_j N_i(m)N_i(m+1)|g_{ij}(m)-g_{ij}(m+1)||\vec{p}_j(m)-\vec{p}_j(m+1)| \tag{9}$$

Since this metric involves a transition from one frame to another, the product of the loudness values of two frames can be used, so that if the loudness of an object in either the m-th frame or (m+1)-th frame is zero, the resulting value of the above error metric will be zero as well. This may be used to handle situations in which an audio object comes into existence, or goes out of existence, in the latter of the two frames; the contribution to the above error metric from such an audio object is zero.

Figure 5:
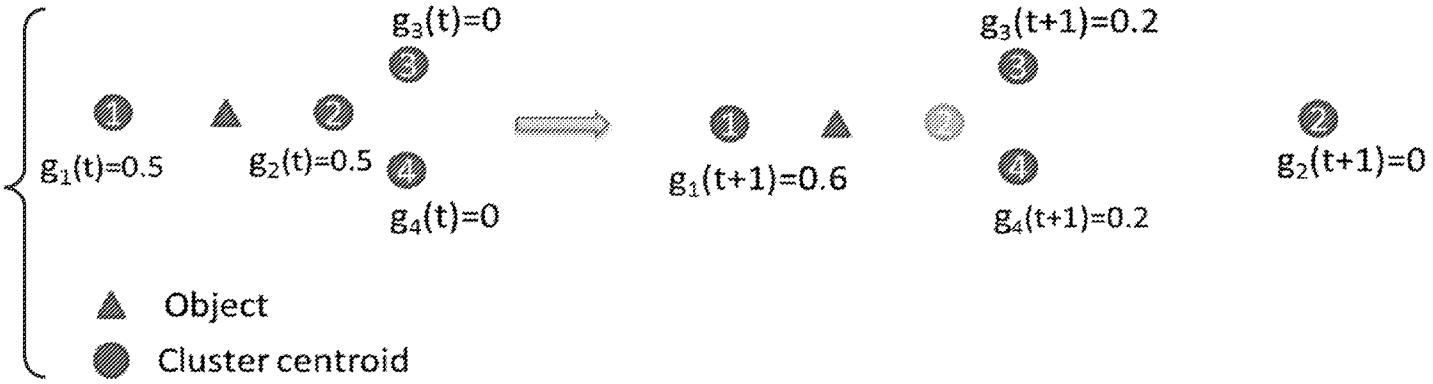
FIG. 5 illustrates an example scenario for computing gain flows.

Another example inter-frame spatial error can be generated for an audio object based on not only changes of gain coefficients of an audio object and positional changes of output clusters to which the audio object is clustered or panned, but also the difference or distance between a first configuration of output clusters into which the audio object is rendered in a first frame (e.g., m-th frame, etc.) and a second configuration of output clusters into which the audio object is rendered in a second frame (e.g., (m+1)-th frame, etc.), as illustrated in FIG. 5. In the example depicted by FIG. 5, the centroid of output cluster 2 jumps or moves to a new position; as a result, the rendering vector of an audio object (denoted as a triangle) and gain coefficients (or gain coefficient distribution) change accordingly. However, in this example, even though the centroid of output cluster 2 jumps a long distance, for the specific audio object (triangle), it can still be well represented/rendered by using both centroids of output clusters 3 and 4. Only considering the jump or difference of positional changes (or changes in the centroids) of the output clusters may over-estimate the inter-frame spatial error or potential artifacts caused between changes relating to adjacent frames (e.g., the m-th and (m+1)-th frames, etc.). This over-estimation may be alleviated by computing and taking into account gain flows underlying the change of gain coefficient distribution of the adjacent frames in determining the inter-frame spatial error relating to the adjacent frames.

In some embodiments, gain coefficients of an audio object in the m-th frame can be represented with a gain vector $[g_1(m), g_2(m), \ldots, g_N(m)]$, where each component (e.g., 1, 2, . . . N, etc.) of the gain vector corresponds to a gain coefficient used to render the audio object into a corresponding output cluster (e.g., 1st output cluster, 2nd output cluster, . . . , N-th output cluster, etc.) in a plurality of output clusters (e.g., N output clusters, etc.). For the purpose of illustration only, the index of audio object in gain coefficients is ignored in components of the gain vector. Gain coefficients of an audio object in the (m+1)-th frame can be represented with a gain vector $[g_1(m+1), g_2(m+1), \ldots, g_N(m+1)]$. Similarly, positions of centroids of the plurality of output clusters in the m-th frame can be represented by a vector $[\vec{p}_1(m), \vec{p}_2(m), \ldots, \vec{p}_N(m)]$. Positions of centroids of the plurality of output clusters in the (m+1)-th frame can be represented by a vector $[\vec{p}_1(m+1), \vec{p}_2(m+1), \ldots, \vec{p}_N(m+1)]$. The inter-frame spatial errors of the audio object from the m-th frame to the (m+1)-th frame can be calculated as shown in the following expression (the loudness, object importance, etc., of the audio object is ignored for now and can be applied later):

$$D(m \rightarrow m+1) = \Sigma_i \Sigma_j g_{i \rightarrow j} d_{i \rightarrow j} \tag{10}$$

where i is the index to centroids of the output clusters in the m-th frame, j is the index to centroids of the output clusters in the (m+1)-th frame. $g_{i \rightarrow j}$ is the value of gain flow from the centroid of the i-th output cluster in the m-th frame to the centroid of the j-th output cluster in the (m+1)-th frame. $d_{i \rightarrow j}$ is the (e.g., gain flow, etc.) distance between the centroid of the i-th output cluster in the m-th frame and the centroid of the j-th output cluster in the (m+1)-th frame, and may be directly calculated as shown in the following expression:

$$d_{i \rightarrow j} = |\vec{p}_i(t) - \vec{p}_j(t+1)| \tag{11}$$

In some embodiments, the gain flow value $g_{i \rightarrow j}$ is estimated by a method comprising the following steps:

1. Initialize $g_{i \rightarrow j}$ to zero. Compute $d_{i \rightarrow j}$ for each pair of (i,j) if $g_i(m)$ and $g_j(m+1)$ are greater than zero (0). Sort $d_{i \rightarrow j}$ in an ascending order.
2. Select the centroid pair (i*,j*) with the smallest distance, where the centroid pair (i*, j*) has not been selected before.
3. Compute the gain flow value as $g_{i^* \rightarrow j^*} = \min(g_{i^*}, g_{j^*})$.
4. Update $g_{i^*} = g_{i^*} - g_{i^* \rightarrow j^*}$, $g_{j^*} = g_{j^*} - g_{i^* \rightarrow j^*}$.
5. If all of the updated $g_i, g_j$ are zero, stop. Otherwise, go to step 2 above.

In the example depicted in FIG. 5, the non-zero gain flows obtained by applying the above method are: $g_{1 \rightarrow 1} = 0.5$, $g_{2 \rightarrow 3} = 0.2$, $g_{2 \rightarrow 4} = 0.2$ and $g_{2 \rightarrow 1} = 0.1$. Accordingly, the inter-frame spatial error for the audio object (denoted with a triangle in FIG. 5) can be computed as follows:

$$\begin{aligned} D(m \rightarrow m+1) &= g_{1 \rightarrow 1} * d_{1 \rightarrow 1} + g_{2 \rightarrow 3} * d_{2 \rightarrow 3} + g_{2 \rightarrow 4} * \\ &\quad d_{2 \rightarrow 4} + g_{2 \rightarrow 1} * d_{2 \rightarrow 1} \\ &= 0.5 * d_{1 \rightarrow 1} + 0.2 * d_{2 \rightarrow 3} + 0.2 * d_{2 \rightarrow 4} + \\ &\quad 0.1 * d_{2 \rightarrow 1} \end{aligned} \tag{12}$$

In comparison, the inter-frame spatial error computed based on expression (8) is as follows:

$$\begin{aligned} D(m \rightarrow m+1) &= |g_2(m) = g_2(m+1)| * |\vec{p}_2(m) - \\ &\quad \vec{p}_2(m+1)| = 0.5 * |\vec{p}_2(t) - \vec{p}_2(t+1)| \end{aligned} \tag{13}$$

As can be seen in expressions (12) and (13), the inter-frame spatial error as computed in expression (13), which solely depends on $|\vec{p}_2(m) - \vec{p}_2(m+1)|$, may overestimate actual spatial error since the movement of the centroid of output cluster 2 does not cause a large spatial error on the audio object due to the presences of the nearby output clusters 3 and 4, which can readily (and relatively accurately in terms of spatial errors) take up the portion (or gain flows) of the gain coefficient previously rendered to output cluster 2 in the m-th frame.

The inter-frame spatial error of audio object k may be denoted as $D_k$. In some embodiments, the overall inter-frame spatial errors can be calculated as follows:

$$E_{inter}(m \rightarrow m+1) = \Sigma_k D_k(m \rightarrow m+1) \tag{14}$$

By considering respective object importance such as partial loudness, etc., of audio objects, the overall inter-frame spatial errors can be further calculated as follows:

$$E_{inter}(m \rightarrow m+1) = \Sigma_k N_k(m) N_k(m+1) D_k(m \rightarrow m+1) \tag{15}$$

where $N_k(m)$ and $N_k(m+1)$ are object importance such as partial loudness, etc., of audio object k in the m-th frame and the (m+1)-th frame, respectively.

In some embodiments, in scenarios in which an audio object is also moving, the movement of the audio object is compensated in computing inter-frame spatial errors, for example, as shown in the following expression:

$$E_{inter}(m \rightarrow m+1) = \Sigma_k N_k(m) N_k N_k(m+1) \max\{D_k(m \rightarrow m+1) - O_k(m \rightarrow m+1), 0\} \tag{16}$$

where $O_k(m \rightarrow m+1)$ is the actual movement of the audio object from the m-th frame to the (m+1)-th frame.

5. Prediction of Subjective Audio Quality

In some embodiments, one, some, or all of spatial error metrics as described herein may be used to predict perceived audio quality (e.g., relating to a perceived audio quality test such as a MUSHRA test, a MOS test, etc.) of one or more frames from which the spatial error metrics are computed. Training dataset (e.g., a set of representative audio content elements or excerpts, etc.) may be used to determine correlations (e.g., negative values reflecting that a higher spatial error results in lower subjective audio quality as measured with users, etc.) between the spatial error metrics and measurements of subjective audio quality collected from a plurality of users. The correlations as determined based on the training dataset may be used to determine prediction parameters. These prediction parameters may be used to generate, based on spatial error metrics computed from one or more frames (e.g., non-training data, etc.), one or more indications of perceived audio quality of the one or more frames. In some embodiments in which a plurality (e.g., intra-frame object position error, intra-frame object panning error, etc.) of spatial error metrics are used to predict subjective audio quality, a spatial error metric (e.g., intra-frame object panning error metric, etc.) that has a relatively high correlation (e.g., a negative value with a relatively large magnitude, etc.) with subjective audio quality (e.g., as measured through a MUSHRA test with respect to a plurality of users based on the training dataset, etc.) may be given a relatively high weight value among the plurality (e.g., intra-frame object position error, intra-frame object panning error, etc.) of spatial error metrics. It should be noted that techniques as described herein can be configured to work with other ways of predicting audio quality based on one or more spatial error metrics as determined by these techniques.

6. Visualization of Spatial Errors and Spatial Complexity

In some embodiments, one or more spatial error metrics as determined under techniques as described herein for one or more frames may be used with properties (e.g., loudness, positions, etc.) of audio objects and/or output clusters in the one or more frames to provide a visualization of spatial complexity of audio content in the one or more frames on a display (e.g., a computer screen, a web page, etc.). The visualization may be provided with a wide variety of graphic user interface components such as a VU meter, (e.g., 2-D, 3-D, etc.) visualization of audio objects and/or output clusters, bar charts, other suitable means, etc. In some embodiments, an overall indication of spatial complexity is provided on a display, for example, as a spatial authoring or conversion process is being performed, after such a process is performed, etc.

FIG. 3A through FIG. 3D illustrate example user interfaces for visualizing spatial complexity in one or more frames. The user interfaces may be provided by a spatial complexity analyzer (e.g., 200 of FIG. 2, etc.) or a user interface module (e.g., 210 of FIG. 2, etc.), a mixing tool, a format conversion tool, an audio object clustering tool, a standalone analysis tool, etc. The user interfaces can be used to provide a visualization of possible audio quality degradation and other related information when audio objects in input audio content are compressed into a (e.g., much, etc.) smaller number of output clusters in output audio content. The visualization of possible audio quality degradation and other related information may be provided concurrently with the production of one or more versions of object-based audio content from the same source audio content.

Figure 3A:
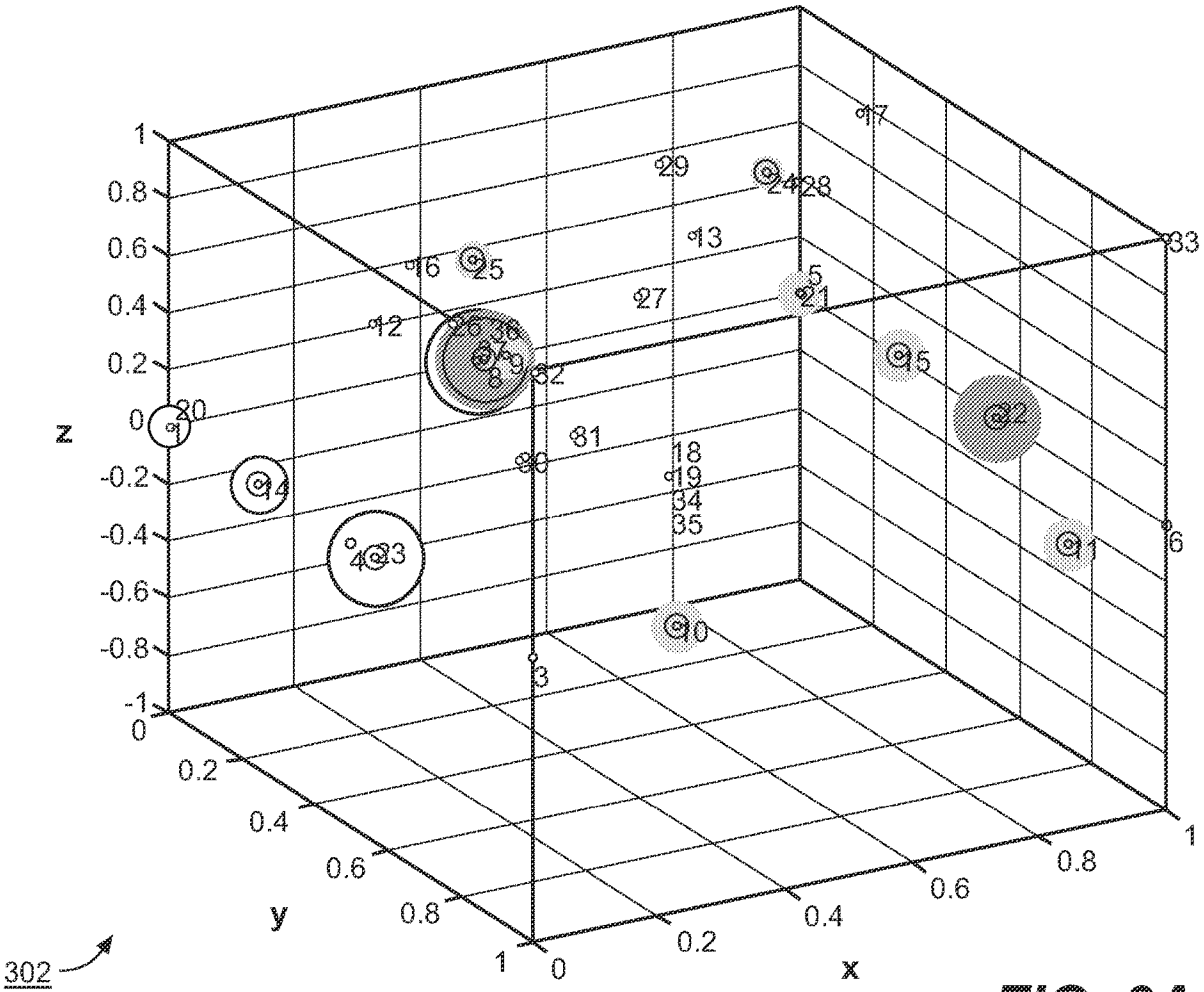
FIG. 3A through FIG. 3D illustrate example user interfaces for a visualization of spatial complexity in one or more frames.

In some embodiments, the user interfaces include 3-D display component 302 that visualizes positions of audio objects and output clusters in an example 3-D listening space, as illustrated in FIG. 3A. Zero, one or more of the audio objects or output clusters as depicted in the user interfaces may have dynamic positions or fixed positions in the listening space.

Figure 3B:
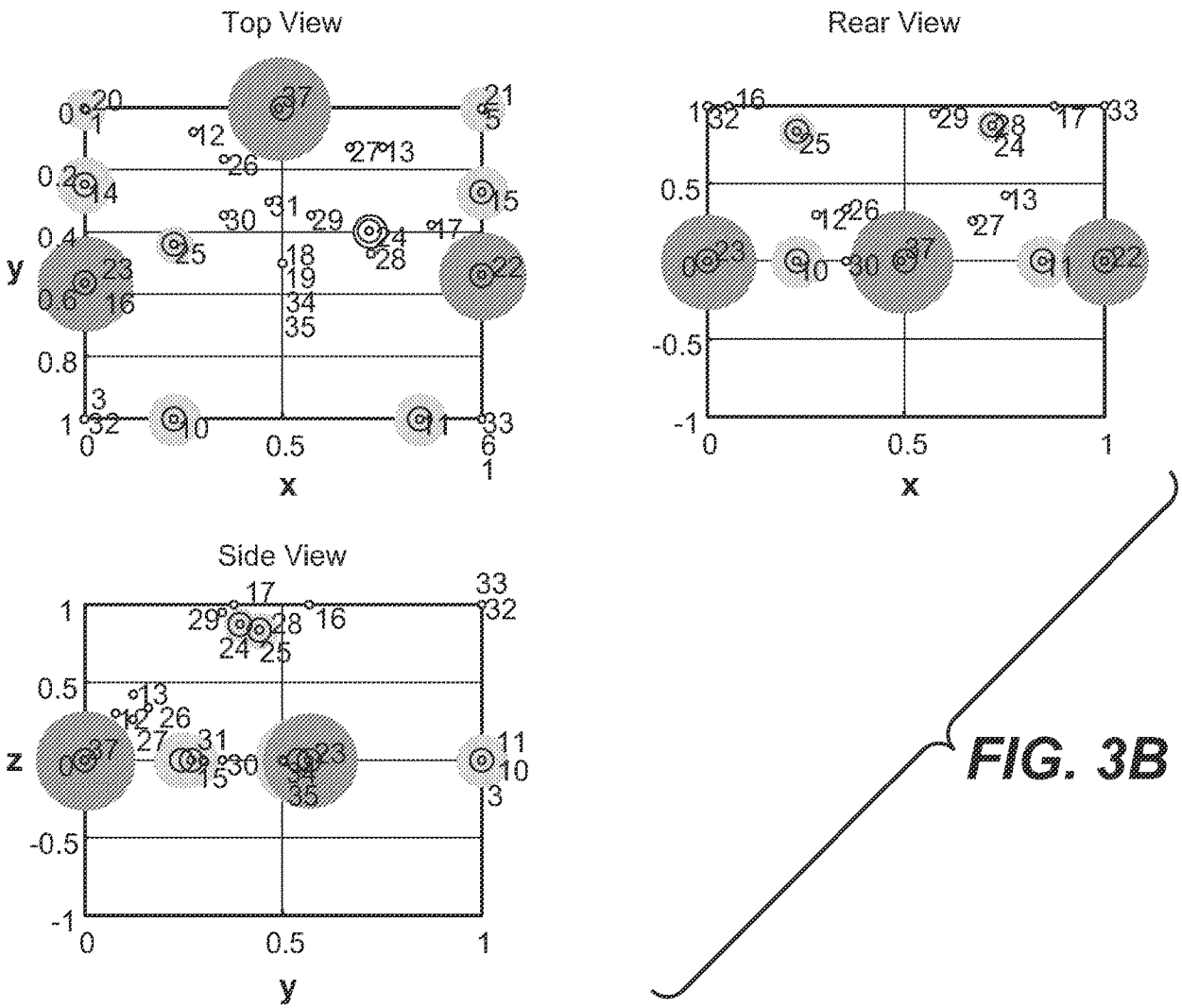

In some embodiments, the user or listener is at the middle of the ground plane of the 3-D listening space. In some embodiments, the user interfaces include different 2-D views of the 3-D listening space such as top view, side view, rear view, etc., representing different projections of the 3-D listening space, as illustrated in FIG. 3B.

Figure 3C:
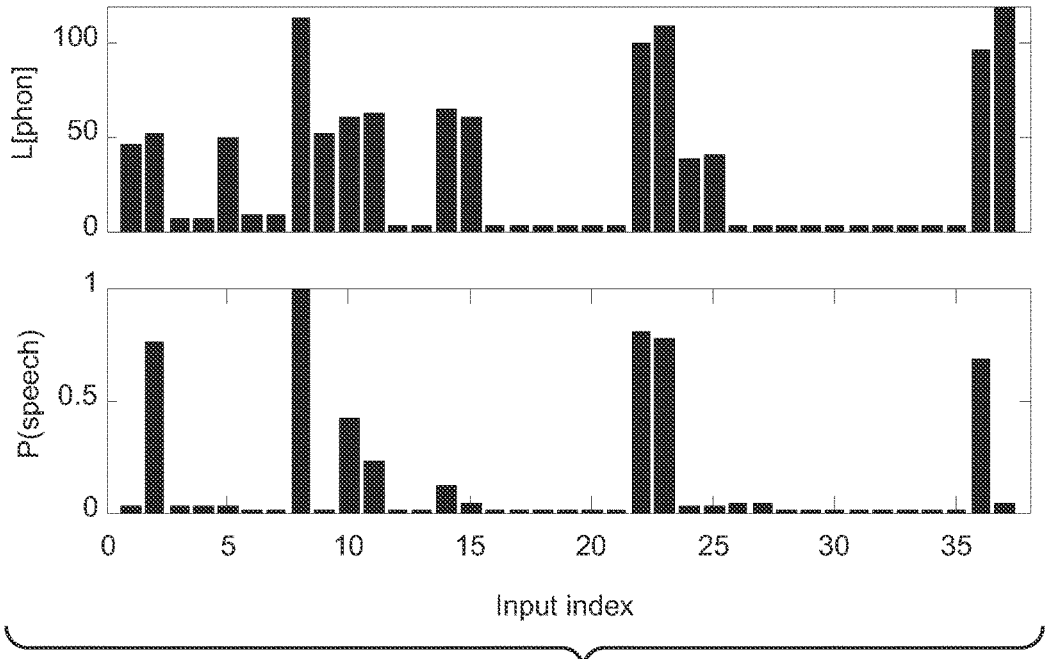

In some embodiments, the user interfaces also include bar charts 304 and 306 that visualize object importance (e.g., determined/estimated based on loudness, semantic dialog probability, etc.) and object loudness L (in unit of phon), respectively, as illustrated in FIG. 3C. The "input index" denotes indexes of audio objects (or output clusters). The height of the vertical bar at each value of the input index indicates the probability of speech or dialog. The vertical axis "L" denotes partial loudness, which may be used as a basis to determine object importance, etc. The vertical axis "P" denotes a probability of speech or dialog content. The vertical bars (representing individual partial loudness and probabilities of speech or dialog content of audio objects or output clusters) in the bar charts 304 and 306 may go up and down from frame to frame.

Figure 3D:
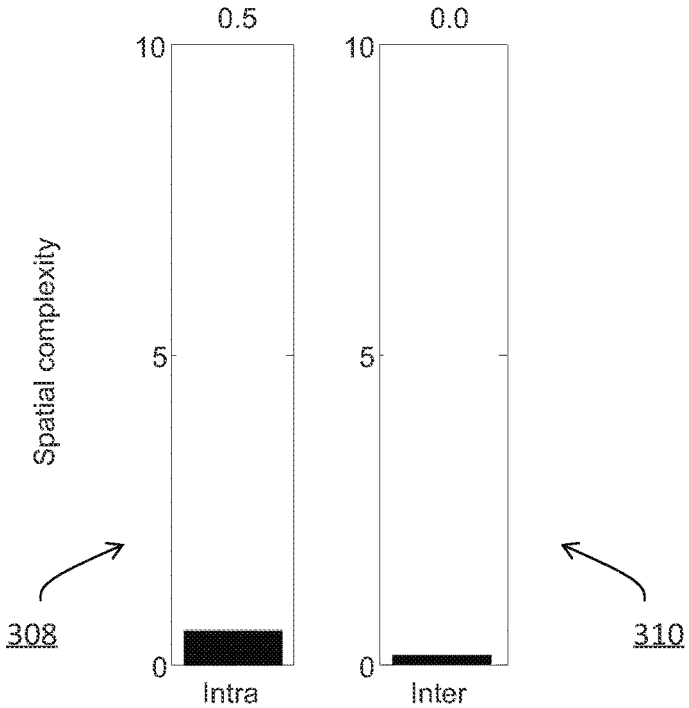

In some embodiments, the user interfaces include a first spatial complexity meter 308 relating to intra-frame spatial errors and a second spatial complexity meter 310 relating to inter-frame spatial errors, as illustrated in FIG. 3D. In some embodiments, spatial complexity of audio content can be quantified or represented by spatial error metrics or predicted audio quality test scores generated from one or more (e.g., different combinations, etc.) of intra-frame spatial error metrics, inter-frame spatial error metrics, etc. In some embodiments, prediction parameters determined based on training data may be used to predict perceptual audio quality degradation based on values of one or more spatial error metrics. The predicted perceptual audio quality degradation may be represented by one or more predicted perceptual test score in reference to a subjective perceptual audio quality test such as a MUSHRA test, a MOS test, etc. In some embodiments, two sets of perceptual test scores may be predicted based at least in part on intra-frame spatial errors and inter-frame spatial errors, respectively. A first set of perceptual test scores, generated based at least in part on the intra-frame spatial errors, may be used to drive the display of the first spatial complexity meter 308. The second set of perceptual test scores, generated based at least in part on the inter-frame spatial errors, may be used to drive the display of the second spatial complexity meter 310.

In some embodiments, an "audible error" indicator light may be depicted in the user interfaces to indicate that predicted audio quality degradation (e.g., in a value range of 0 to 10, etc.) as represented by one or more of the spatial complexity meters (e.g., 308, 310, etc.) has crossed a configured "annoying" threshold (e.g., 10, etc.). In some embodiments, the "audible error" indicator light is not depicted if none of the spatial complexity meters (e.g., 308, 310, etc.) crosses a configured "annoying" threshold (e.g., with a numeric value of 10, etc.), but can be triggered as one of the spatial complexity meters crosses the configured "annoying" threshold. In some embodiments, different sub-ranges of predicted audio quality degradation in a spatial complexity meter (e.g., 308, 310, etc.) may be represented by bands of different colors (e.g., a sub-range of 0-3 is mapped to a green band indicating minimal audio quality degradation, a sub-range of 8-10 is mapped to a red band indicating severe audio quality degradation, etc.).

Audio objects are depicted in FIG. 3A and FIG. 3B as circles. However, in various embodiments, audio objects or output clusters can be depicted using different shapes. In some embodiments, sizes of shapes representing audio objects or output clusters may indicate (e.g., may be proportional to, etc.) object importance of the audio objects, absolute or relative loudness of the audio objects or output clusters, etc. Different color coding schemes may be used to color user interface components in the user interfaces. For example, an audio object may be colored green, whereas an output cluster may be colored with a non-green color. Different shades of the same color may be used to differentiate different values of a property of an audio object. The color of an audio object may be changed based on properties of the audio object, spatial errors of the audio objects, distances of the audio object with respect to output clusters to which the audio object is apportioned or assigned, etc.

Figure 4:
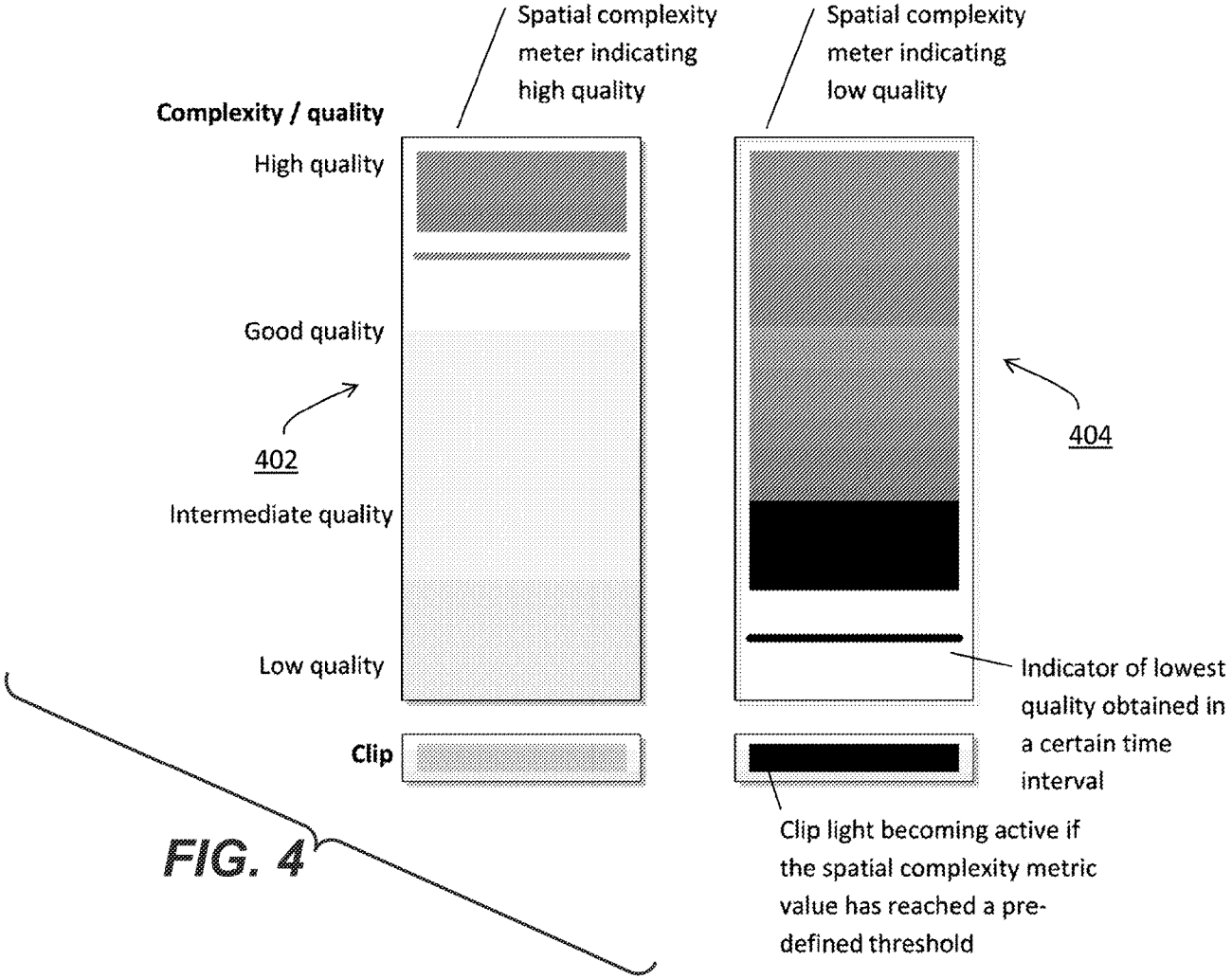
FIG. 4 illustrates two example visual complexity meter instances.

FIG. 4 illustrates two example instances 402 and 404 of a visual complexity meter in the form of a VU meter. The VU meter may be a part of the user interfaces depicted in FIG. 3A through FIG. 3D or a different user interface (e.g., as provided by a user interface module 210 of FIG. 2, etc.) other than the user interfaces depicted in FIG. 3A through FIG. 3D. The first instance 402 of the visual complexity meter indicates high audio quality and low spatial complexity, corresponding to low spatial errors. The second instance 404 of the visual complexity meter indicates low audio quality and high spatial complexity, corresponding to high spatial errors. Complexity metric values that are indicated in the VU meter may be intra-frame spatial errors, inter-frame spatial errors, perceptual audio quality test scores predicted/determined based on intra-frame spatial errors, predicted audio quality test scores predicted/determined based on inter-frame spatial errors, etc. Additionally, optionally, or alternatively, the VU meter may comprise/implement a "peak hold" function configured to display the lowest quality and highest complexity occurring in a certain (e.g., past, etc.) time interval. This time interval may be fixed (e.g., the last 10 seconds, etc.), or may be variable and relative to the start of the audio content that is being processed. Also, numerical displays of complexity metric values may be used in conjunction, or alternative to VU meter displays.

As illustrated in FIG. 4, a complexity clip light can be displayed below a vertical scale representing the complexity meter. This clip light may become active if the complexity value has reached/crossed a certain critical threshold. This may be visualized by lighting up, changing color, or any other change that can be perceived visually. In some embodiments, instead of or in addition to showing the complexity labels (e.g., high, good, intermediate and low quality, etc.), the vertical scale may also be numerical (e.g., from 0 to 10, etc.) to indicate the complexity or audio quality.

7. Example Process Flow

Figure 6:
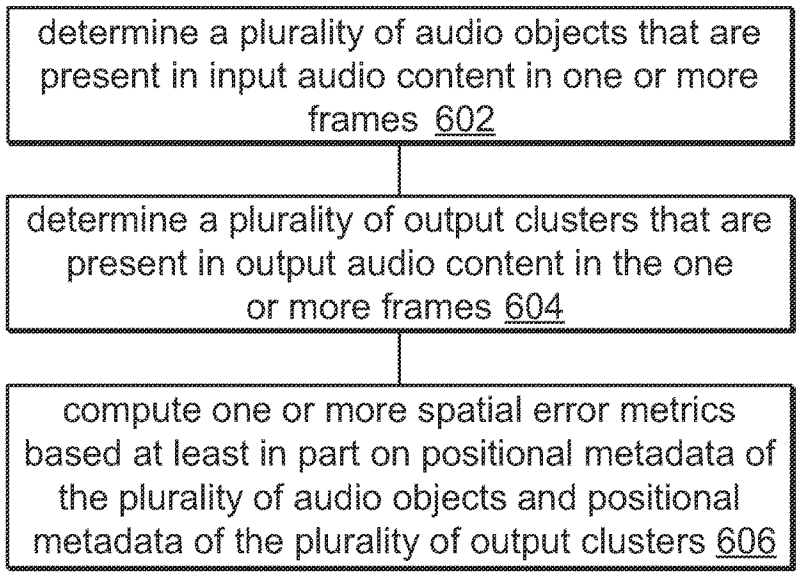
FIG. 6 illustrates an example process flow.

FIG. 6 illustrates an example process flow. In some embodiments, one or more computing devices or units (e.g., a spatial complexity analyzer 200 of FIG. 2, etc.) may perform the process flow.

In block 602, a spatial complexity analyzer 200 (e.g., as illustrated in FIG. 2, etc.) determines a plurality of audio objects that are present in input audio content in one or more frames.

In block 604, the spatial complexity analyzer (200) determines a plurality of output clusters that are present in output audio content in the one or more frames. Here, the plurality of audio objects in the input audio content is converted to the plurality of output clusters in the output audio content.

In block 606, the spatial complexity analyzer (200) computes one or more spatial error metrics based at least in part on positional metadata of the plurality of audio objects and positional metadata of the plurality of output clusters.

In an embodiment, at least one audio object in the plurality of audio objects is apportioned to two or more output clusters in the plurality of output clusters.

In an embodiment, at least one audio object in the plurality of audio objects is assigned to an output cluster in the plurality of output clusters.

In an embodiment, the spatial complexity analyzer (200) is further configured to determine, based on the one or more spatial error metrics, perceptual audio quality degradation caused by converting the plurality of audio objects in the input audio content to the plurality of output clusters in the output clusters.

In an embodiment, the perceptual audio quality degradation is represented by one or more predicted test scores relating to a perceptual audio quality test.

In an embodiment, the one or more spatial error metrics comprise at least one of: intra-frame spatial error metrics or inter-frame spatial error metrics.

In an embodiment, the intra-frame spatial error metrics comprise at least one of: intra-frame object position error metrics, intra-frame object panning error metrics, importance-weighted intra-frame object position error metrics, importance-weighted intra-frame object panning error metrics, normalized intra-frame object position error metrics, normalized intra-frame object panning error metrics, etc.

In an embodiment, the inter-frame spatial error metrics comprise at least one of: inter-frame spatial error metrics based on gain coefficient flows, inter-frame spatial error metrics not based on gain coefficient flows, etc.

In an embodiment, each of the inter-frame spatial error metrics is computed in relation to two different frames.

In an embodiment, the plurality of audio objects relates to the plurality of output clusters via a plurality of gain coefficients.

In an embodiment, each of the frames corresponds to a time segment in the input audio content and a second time segment in the output audio content; output clusters that are present in the second time segment in the output audio content are mapped to by audio objects that are present in the first time segment in the input audio content.

In an embodiment, the one or more frames comprise two consecutive frames.

In an embodiment, the spatial complexity analyzer (200) is further configured to perform: constructing one or more user interface components that represent one or more of: audio objects in the plurality of audio objects, output clusters in the plurality of output clusters in a listening space, etc.; and causing the one or more user interface components to be displayed to a user.

In an embodiment, a user interface component in the one or more user interface components represents an audio object in the plurality of audio objects; the audio object is mapped to one or more output clusters in the plurality of output clusters; and at least one visual characteristic of the user interface component represents a total amount of one or more spatial errors related to mapping the audio object to the one or more output clusters.

In an embodiment, the one or more user interface components comprise a representation of the listening space in a 3-dimensional (3-D) form.

In an embodiment, the one or more user interface components comprise a representation of the listening space in a 2-dimensional (2-D) form.

In an embodiment, the spatial complexity analyzer (200) is further configured to perform: constructing one or more user interface components that represent one or more of: respective object importance of audio objects in the plurality of audio objects, respective object importance of output clusters in the plurality of output clusters, respective loudness of audio objects in the plurality of audio objects, respective loudness of output clusters in the plurality of output clusters, respective probabilities of speech or dialog content of audio objects in the plurality of audio objects, probabilities of speech or dialog content of output clusters in the plurality of output clusters, etc.; and causing the one or more user interface components to be displayed to a user.

In an embodiment, the spatial complexity analyzer (200) is further configured to perform: constructing one or more user interface components that represent one or more of: the one or more spatial error metrics, one or more predicted test scores determined based at least in part on the one or more spatial error metrics, etc.; and causing the one or more user interface components to be displayed to a user.

In an embodiment, a conversion process converts time-dependent audio objects present in the input audio content to time-dependent output clusters constituting the output clusters; and the one or more user interface components comprises a visual indication of the worst audio quality degradation occurring in the conversion process for a past time interval that includes and is up to the one or more frames.

In an embodiment, the one or more user interface components comprise a visual indication that audio quality degradation, occurring in a conversion process for a past time interval that includes and is up to the one or more frames, has exceeded an audio quality degradation threshold.

In an embodiment, the one or more user interface components comprise a vertical bar whose height is indicative of audio quality degradation in the one or more frames, and wherein the vertical bar is color-coded based on the audio quality degradation in the one or more frames.

In an embodiment, an output cluster in the plurality of output clusters comprises portions mapped to by two or more audio objects in the plurality of audio objects.

In an embodiment, at least one of audio objects in the plurality of audio objects or output clusters in the plurality of output clusters has a dynamic position that varies over time.

In an embodiment, at least one of audio objects in the plurality of audio objects or output clusters in the plurality of output clusters has a fixed position that does not vary over time.

In an embodiment, at least one of the input audio content or the output audio content is a part of one of audio only signals, or audiovisual signals.

In an embodiment, the spatial complexity analyzer (200) is further configured to perform: receiving user input that specifies a change to a conversion process that converts the input audio content to the output audio content; and in response to receiving the user input, causing the change to the conversion process that converts the input audio content to the output audio content.

In an embodiment, any of the method as described above is performed concurrently while the conversion process is converting the input audio content to the output audio content.

Embodiments include, a media processing system configured to perform any one of the methods as described herein.

Embodiments include an apparatus comprising a processor and configured to perform any one of the foregoing methods.

Embodiments include a non-transitory computer readable storage medium, storing software instructions, which when executed by one or more processors cause performance of any one of the foregoing methods. Note that, although separate embodiments are discussed herein, any combination of embodiments and/or partial embodiments discussed herein may be combined to form further embodiments.

8. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 7:
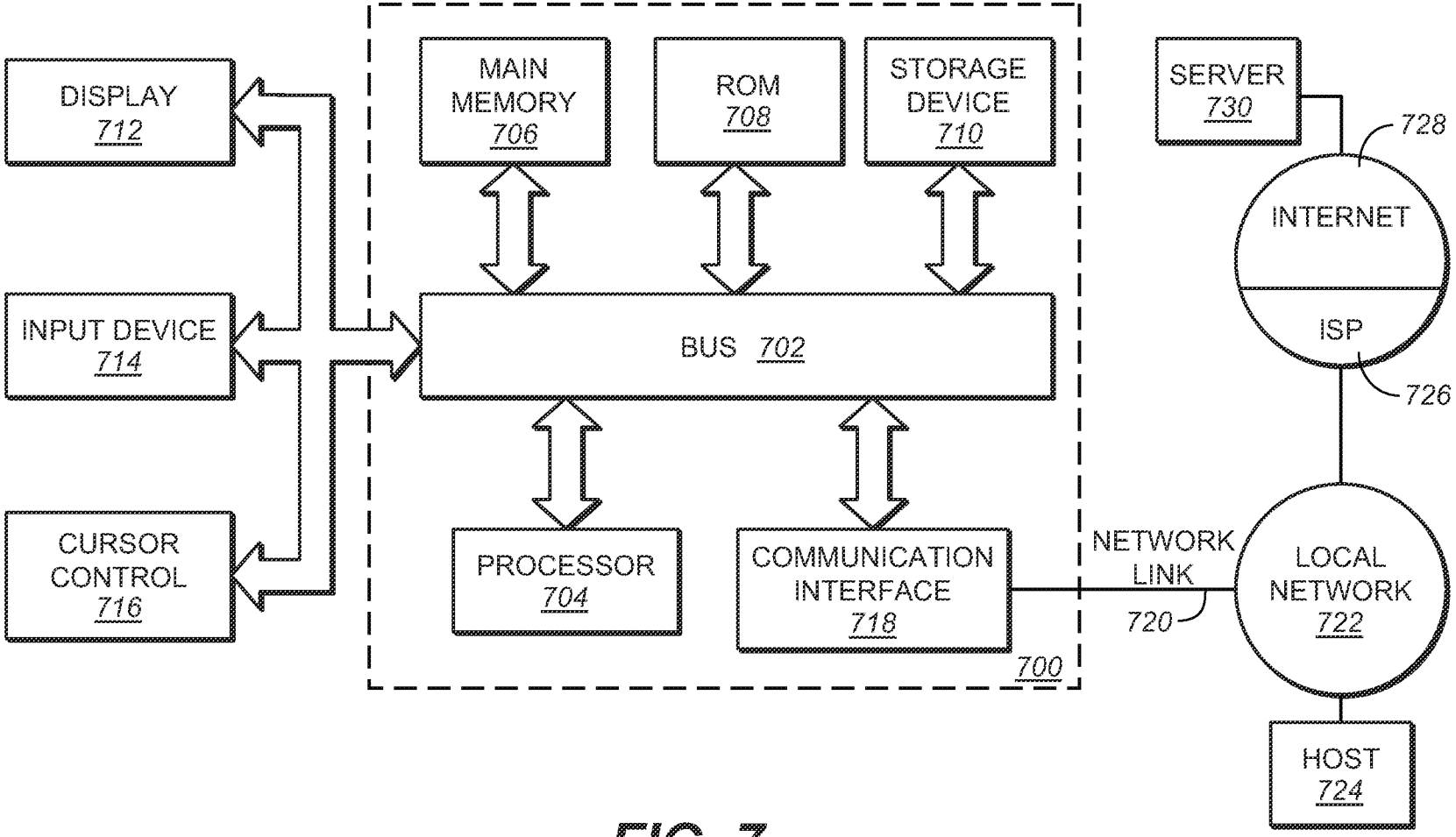
FIG. 7 illustrates an example hardware platform on which a computer or a computing device as described herein may be implemented.

For example, FIG. 7 is a block diagram that illustrates a computer system 700 upon which an embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in non-transitory storage media accessible to processor 704, render computer system 700 into a special-purpose machine that is device-specific to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712, such as a liquid crystal display (LCD), for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane.

Computer system 700 may implement the techniques described herein using device-specific hard-wired logic, one or more ASICs or FPGAs, firmware and/or program logic which in combination with the computer system causes or programs computer system 700 to be a special-purpose machine. According to one embodiment, the techniques herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any non-transitory media that store data and/or instructions that cause a machine to operation in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media.

Computer system 700 can send messages and receive data, including program code, through the network(s), network link 720 and communication interface 718. In the Internet example, a server 730 might transmit a requested code for an application program through Internet 728, ISP 726, local network 722 and communication interface 718.

The received code may be executed by processor 704 as it is received, and/or stored in storage device 710, or other non-volatile storage for later execution.

9. Equivalents, Extensions, Alternatives and Miscellaneous

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method, comprising:

determining a plurality of audio objects that are present in input audio content in one or more frames;

determining a plurality of output clusters that are present in output audio content in the one or more frames, the plurality of audio objects in the input audio content being converted to the plurality of output clusters in the output audio content; and computing one or more spatial error metrics based at least in part on positional metadata of the plurality of audio objects and positional metadata of the plurality of output clusters;

wherein computing one or more spatial error metrics based at least in part on positional metadata of the plurality of audio objects and positional metadata of the plurality of output clusters comprises:

identifying a center of mass for each audio object in the plurality of audio objects based on (a) a plurality of gain coefficients for each such audio object and (b) a plurality of output cluster positions for the plurality of output clusters, wherein each gain coefficient in the plurality of gain coefficients corresponds to a respective output cluster in the plurality of output clusters, wherein each output cluster position in the plurality of output cluster positions corresponds to a respective output cluster in the plurality of output clusters, wherein the plurality of output cluster positions are determined based on the positional metadata of the plurality of output clusters;

determining a positional difference between a position of each such audio object in the plurality of audio objects and the center of mass for each such object in the plurality of audio objects, wherein the position of each such audio object in the plurality of audio objects is determined based on the positional metadata of the plurality of audio objects;

determining the one or more spatial error metrics based at least in part on the positional difference between the position of each such audio object in the plurality of audio objects and the center of mass for each such object in the plurality of audio objects;

wherein the method is performed by one or more computing devices.

2. The method as recited in claim 1, wherein the one or more spatial error metrics are at least in part dependent on object importance.

3. The method as recited in claim 2, wherein the object importance is obtained from analyzing one or more of audio data in the plurality of audio objects, audio data in the plurality of output clusters, metadata in the plurality of audio objects, or metadata in the plurality of output clusters.

4. The method as recited in claim 2, wherein at least a portion of the object importance is determined based on user input.

5. The method as recited in claim 1, wherein at least one audio object in the plurality of audio objects is apportioned to two or more output clusters in the plurality of output clusters.

6. The method as recited in claim 1, wherein at least one audio object in the plurality of audio objects is assigned to an output cluster in the plurality of output clusters.

7. The method as recited in claim 1, further comprising:

determining, based on the one or more spatial error metrics, perceptual audio quality degradation caused by converting the plurality of audio objects in the input audio content to the plurality of output clusters in the output clusters.

8. The method as recited in claim 7, wherein the perceptual audio quality degradation is represented by one or more predicted test scores relating to a perceptual audio quality test.

9. The method as recited in claim 1, wherein the one or more spatial error metrics comprise at least one of: intra-frame spatial error metrics or inter-frame spatial error metrics.

10. The method as recited in claim 9, wherein the intra-frame spatial error metrics comprise at least one of: intra-frame object position error metrics, intra-frame object panning error metrics, importance-weighted intra-frame object position error metrics, importance-weighted intra-frame object panning error metrics, normalized intra-frame object position error metrics, or normalized intra-frame object panning error metrics.

11. The method as recited in claim 9, wherein the inter-frame spatial error metrics comprise at least one of: inter-frame spatial error metrics based on gain coefficient flows, or inter-frame spatial error metrics not based on gain coefficient flows.

12. The method as recited in claim 9, wherein each of the inter-frame spatial error metrics is computed in relation to two or more different frames.

13. The method as recited in claim 1, wherein the plurality of audio objects relates to the plurality of output clusters via a plurality of gain coefficients.

14. The method as recited in claim 1, wherein each of the frames corresponds to a time segment in the input audio content and a second time segment in the output audio content; and wherein output clusters that are present in the second time segment in the output audio content are mapped to by audio objects that are present in the first time segment in the input audio content.

15. The method as recited in claim 1, further comprising:

constructing one or more user interface components that represent one or more of: audio objects in the plurality of audio objects, or output clusters in the plurality of output clusters in a listening space;

causing the one or more user interface components to be displayed to a user.

16. The method as recited in claim 15, wherein a user interface component in the one or more user interface components represents an audio object in the plurality of audio objects; wherein the audio object is mapped to one or more output clusters in the plurality of output clusters; and wherein at least one visual characteristic of the user interface component represents a total amount of one or more spatial errors related to mapping the audio object to the one or more output clusters.

17. The method as recited in claim 15, wherein the one or more user interface components comprise a representation of the listening space in a 3-dimensional (3-D) form.

18. The method as recited in claim 15, wherein the one or more user interface components comprise a representation of the listening space in a 2-dimensional (2-D) form.

19. The method as recited in claim 1, further comprising:

constructing one or more user interface components that represent one or more of: respective object importance of audio objects in the plurality of audio objects, respective object importance of output clusters in the plurality of output clusters, respective loudness of audio objects in the plurality of audio objects, respective loudness of output clusters in the plurality of output clusters, respective probabilities of speech or dialog content of audio objects in the plurality of audio objects, or probabilities of speech or dialog content of output clusters in the plurality of output clusters;

causing the one or more user interface components to be displayed to a user.

20. A non-transitory computer readable storage medium, storing software instructions, which when executed by one or more processors cause performance of the method recited in claim 1.

21. An apparatus, comprising:

one or more computing processors;

one or more non-transitory computer-readable storage media storing software instructions, which when executed by one or more processors cause performance of the method as recited in claim 1.

* * * * *